US005307871A

United States Patent [19]

Jalilevand et al.

[11] Patent Number: 5,307,871

[45] Date of Patent: May 3, 1994

[54] TUBE SUPPORT MEMBER FOR A HEAT EXCHANGER

[75] Inventors: Ali Jalilevand, Plymouth; Ramchandra L. Patel, Southgate, both of Mich.

[73] Assignee: Ford Motor Company, Dearborn, Mich.

[21] Appl. No.: 67,654

[22] Filed: May 26, 1993

[51] Int. Cl.[5] ..... F28F 9/02

[52] U.S. Cl. ..... 165/173; 165/176

[58] Field of Search ..... 165/149, 173, 176

[56] References Cited

U.S. PATENT DOCUMENTS 1,788,068 12/1928 Scott .
1,991,176 4/1933 Rutishauser .
3,216,749 4/1960 Summerfield .
4,159,741 7/1979 Nonnenmann et al. ..... 165/173
4,305,459 12/1981 Nonnenmann et al. ..... 165/173
4,334,703 6/1982 Arthur et al. .
4,759,405 7/1988 Metzger ..... 165/176 X
5,181,561 1/1993 Ayers et al. .
5,190,101 3/1993 Jalilevand et al. .
5,228,512 7/1993 Bretl et al. ..... 165/173 X

FOREIGN PATENT DOCUMENTS 719997 10/1965 Canada .

*Primary Examiner*—John C. Fox
*Attorney, Agent, or Firm*—Raymond L. Coppiellie; Roger L. May

[57] ABSTRACT

A tube supporting member for an automotive heat exchanger is disclosed wherein the support member includes a plurality of apertures each having a cylindrical ferrule portion extending therefrom. The apertures include a curvilinear portion terminating in a discontinuous radius to form a corner at the aperture. The ferrule portions support the tube members of the heat exchanger.

11 Claims, 2 Drawing Sheets

TUBE SUPPORT MEMBER FOR A HEAT EXCHANGER

BACKGROUND OF THE INVENTION

1. Field of the Invention

The present invention relates generally to tube supporting members for heat exchangers such as condensers, evaporators and oil coolers used in automotive vehicles. More particularly, the present invention relates to an endsheet for use in a fin and tube type heat exchanger wherein the endsheet provides increased support for the heat exchanger tubing.

2. Disclosure Information

Fin and tube type heat exchanger are commonly used in vehicle, industrial and residential environments for heating and cooling purposes. Typically, these heat exchanger utilize a plurality of tubes to form a condenser or the like by having the fluid pass through a plurality of U-shaped tubes. The number of U-shape tubes depends on a thermal capacity requirements of the fin and tub heat exchanger. A manifold interconnects these tubes so that the fluid can flow through the tubes.

Endsheets or headers support the heat exchanger tubes and mount the heat exchanger to the vehicle structure. Typical prior art endsheets, such as shown in U.S. Pat. No. 5,190,101, assigned to the assignee of the present invention, are stamped from a metal blank and include apertures through which the tubes are passed. The apertures provide little support for the tubing, the support being equal to the thickness of the endsheet. These prior art endsheets have worked well in the past for heat exchanger below a critical size. However, when the heat exchanger becomes larger and heavier or the application in which the heat exchanger used is subject to severe stresses, the prior art endsheets may not provide enough support for the tubes, resulting in leakage at the tube-manifold interface. Therefore, it would be advantageous to provide an endsheet or tube support member which provides increased support for the tube and fin exchanger.

U.S. Pat. No. 5,181,561 proposes one type of type supporting member for a heat exchanger used in the aircraft industry. The '561 patent discloses a stiffener plate having a plurality of openings for receiving the tubes therethrough. Each opening is in the form of an integral short-length tubular ferrule portion of internal diameter slightly greater than the external diameter of the tube. The ferrule supports the tubular member. Each ferrule of the '561 patent is formed through an extrusion process and includes a smooth, continuous radius for the tube to pass through. This smooth, continuous radius of the stiffener plate in the '561 patent cannot be used however in certain types of automotive heat exchangers. In the manufacturing of certain automotive type heat exchanger, such as condensers, it is necessary that a mandrel be inserted through the tube after the tube has been placed through the endsheet to expand the diameter of the tube to increase the tube-fin contact area. It has been found that using a stiffener plate, such as that in the '561 patent with a ferrule having a smooth continuous radius, allows the tubing to slide through the endsheet during the expansion process, and thus destroying the condenser during the manufacturing process. Therefore, it would be advantageous to provide a tubular support member, such as an endsheet for condenser, which would allow for increased support of the tubular members and which does not allow the tubing to slide therethrough during the manufacturing process.

SUMMARY OF THE INVENTION

The present invention overcomes the disadvantages associated with the prior art by providing a heat exchanger for an automotive vehicle comprising a manifold assembly, a plurality of tubular elements connected to the manifold assembly and defining air paths between adjacent pairs of tubular elements, and a plurality of fin elements provided in the air paths. The heat exchanger further comprises at least one support member disposed adjacent the manifold assembly, the support member having a generally planar base portion including a plurality of tube receiving apertures therein. Each of the apertures includes a curvilinear portion terminating in a discontinuous radius and forming a cylindrically extending ferrule portion of predetermined length thereby. The ferrule portion extends generally perpendicularly to the plane of the base portion and is configured to support a tubular element. By providing the discontinuous radius at the aperture, the tubular elements are prevented from sliding through the endsheet during the manufacturing process.

It is an advantage of the present invention to improve the fatigue life of a fin and tube heat exchanger by providing increased support to the tubular elements thereof. These and other objects, features and advantages of the present invention will become apparent from the drawings, detailed description and claims which follow.

DETAILED DESCRIPTION OF THE PREFERRED EMBODIMENTS

Figure 1:
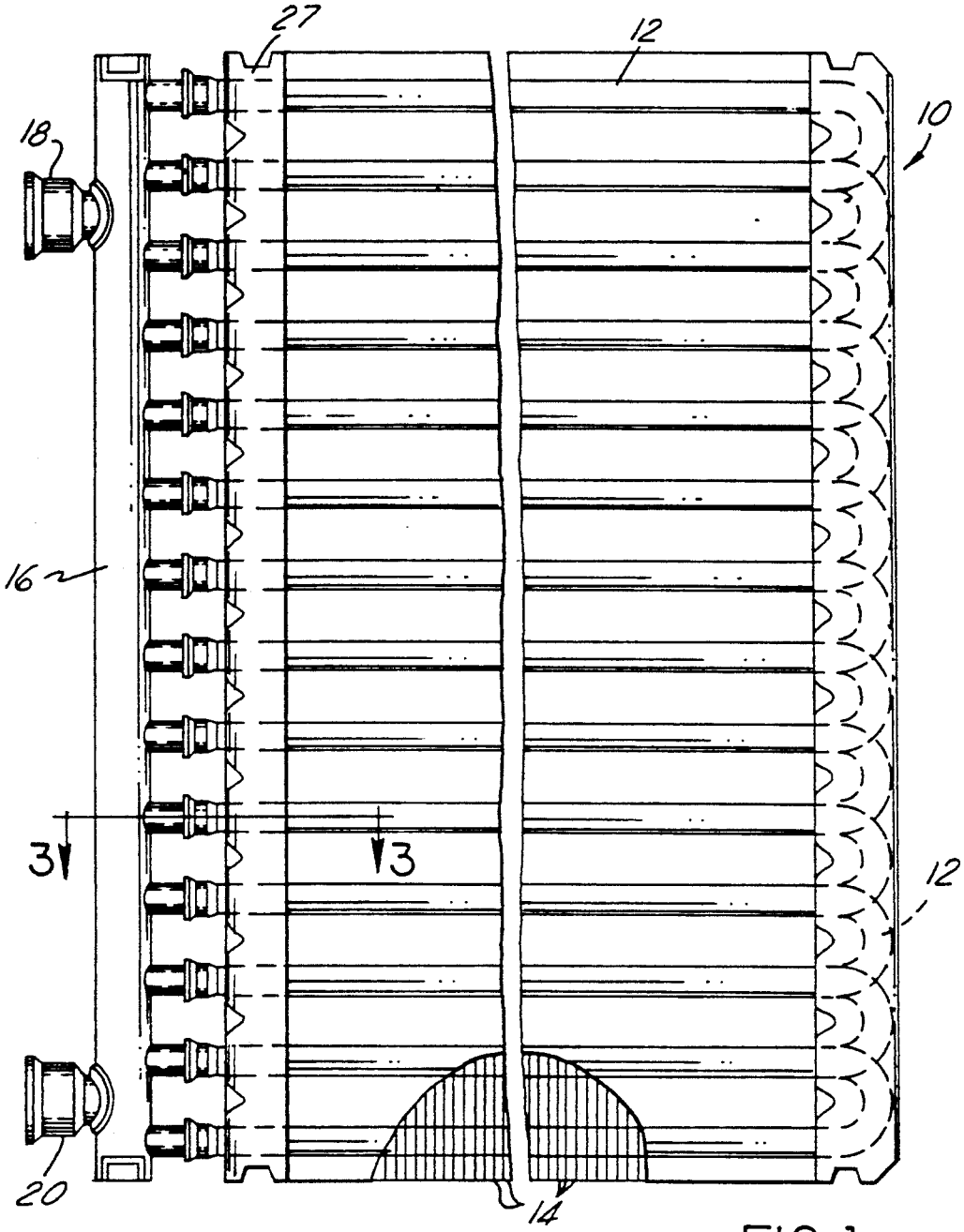
FIG. 1 is a perspective view of a tube and fin heat exchanger including an endsheet structured in accordance with the principles of the present invention.
Figure 3:
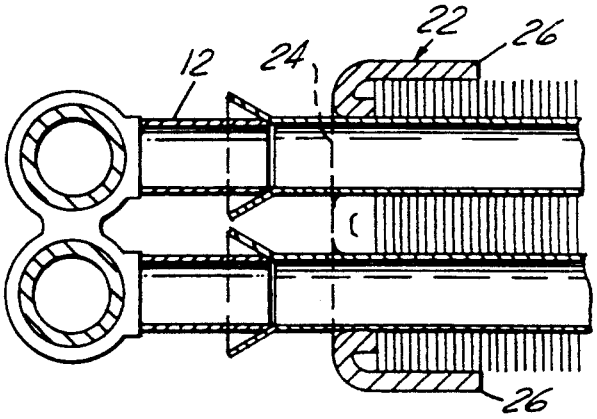
FIG. 3 is a cross sectional view taken along line 3—3 of FIG. 1.

Referring now to the drawings, FIG. 1 shows a tube and fin heat exchanger 10 including a plurality of U-shaped tubes 12 with heat dissipative fins 14 interposed between each of the tubes 12. The free ends of the U-shaped tubes 12 engage a manifold 16 disposed at one end of the heat exchanger 10. The manifold 16 can be any of a number of known configurations of manifolds such as that disclosed in U.S. Pat. No. 5,190,101, assigned to the assignee of the present invention and which is hereby incorporated by reference. As shown in the '101 patent, the manifold is a double chamber manifold having a first and second fluid conduit, including an inlet port 18 for receiving fluid therein and an outlet port 20 for discharge of fluid therefrom. As further explained in the '101 patent, the manifold includes a plurality of baffles for directing the fluid through the heat exchanger according to a predefined pathway. In accordance with principles well known in the heat exchanger art, fluid to be cooled (or heated) enters the manifold 16 through the inlet port 18 and is directed through the plurality of U-shaped tubes 12 wherein the fluid is cooled by a secondary fluid, such as air, passing over the fins 14. The baffles in the manifold direct the fluid through the U-shaped tubes wherein the fluid eventually discharges from outlet port 20. It should be apparent to those skilled in the art that the heat exchanger FIG. 1 can utilize a manifold having a single fluid conduit or multiple fluid conduits.

Figure 2:
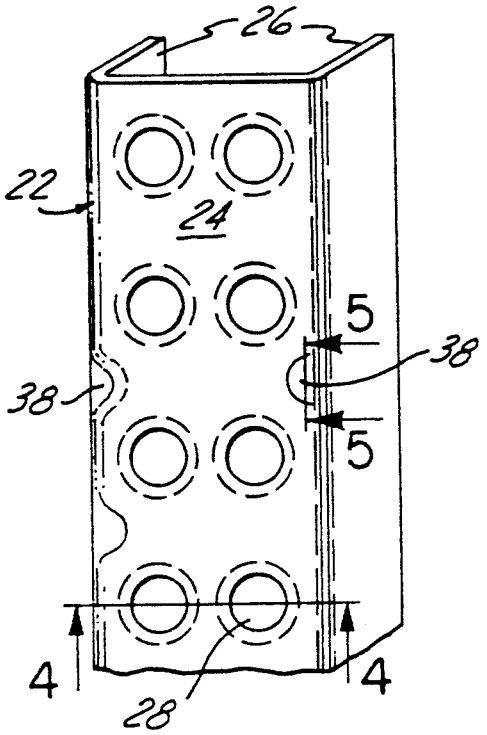
FIG. 2 is a partial perspective view of the endsheet of FIG. 1.

The heat exchanger 10, such as an automotive condenser further includes a pair of tube supporting members, such as endsheets 22. One endsheet is disposed adjacent the manifold while a second endsheet is disposed at an opposite end of the condenser from the manifold 16. Each of the endsheets 22 support the tubes 12 and can further be utilized as attachment means for attaching the condensers to the vehicle. As shown in FIG. 2, the endsheet 22 is a generally U-shaped member having a planar base portion 24 and a pair of flanges 26 extending perpendicularly therefrom. The base portion 24 includes a plurality of tube receiving apertures 28 and strengthening ribs 38 disposed between adjacent pairs of apertures.

Figure 4:
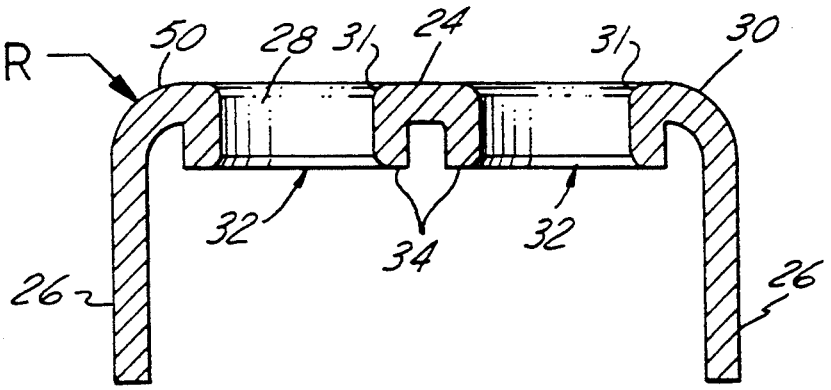
FIG. 4 is a cross sectional view taken along line 4—4 of FIG. 2.

As shown in further detail in FIG. 4, each of the apertures 28 includes a curvilinear linear portion 30 of predetermined radius. The curvilinear portion 30 terminates in a discontinuous radius to form a distinct corner 31 on one side of the planar base portion 24 of the endsheet 22. The apertures 28 each form a cylindrically extending, tube-supporting ferrule portion 32 of predetermined length which extends generally perpendicularly to the plane of the base portion on the side of the base opposite corner 31. The length of ferrule is proportional to the diameter of the apertures 28 as well as the tubes 12. To provide for maximum support of the tubes 12, the length of the ferrule portions 32 should be at least 25% greater than the diameter apertures 28 or the diameter of the tubes 12. In the preferred embodiments, the ferrule portion 32 is 30% greater than the diameter of the aperture 28.

The corners 31 of each aperture prevent the tubes 12 from sliding through the endsheet 22 during the expansion of the tube during the manufacturing process. As explained above, it has been found that an aperture 28 having a smooth radius of curvature does not prevent the tube from sliding through the endsheet during the expansion of the tube. By providing an abrupt, discontinuous radius at corner 31, the tube is prevented from sliding therepast during the expansion process, thus reducing the amount of waste in manufacturing the heat exchangers. Furthermore, the terminating end 34 of each ferrule include a chamfered surface 36. The chamfered surface allows for ease of insertion of the tube 12 through the aperture 28 during the manufacturing process. By providing the discontinuous radius at corner 31 and a chamfered surface 36 of the ferrule portions, it has been found that the fatigue life of the heat exchanger at the interface of the heat exchanger tube 12 and the endsheet 22 is improved by as much 80 percent over prior endsheet designs which simply have pierced or extruded holes.

Figure 5:
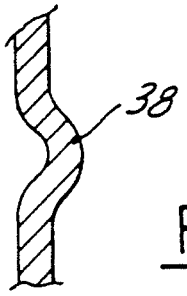
FIG. 5 is a partial sectional view taken along line 5—5 of FIG. 2.

As shown in FIG. 5, each endsheet further includes a plurality of strengthening ribs 38 formed between adjacent pairs of apertures 28 at the junction of the flanges 26 to the base portion 24 of the endsheet 22. These ribs 38 allow the endsheet to be manufactured from a thicker material than in prior art designs and provide for a more robust endsheet which further improves the structural rigidity of the endsheet to improve its fatigue life and that of the heat exchanger.

The endsheet 22 of the present invention is manufactured according to the following method. A flat blank of aluminum or steel is used to manufacture the endsheet. The mounting holes and tooling holes of the endsheet are first pierced through the flat blank of aluminum and the blank is bent into its U-shape configuration. After the endsheet has been bent, the apertures 28 are formed therein through an extrusion process. The extrusion process causes the tube supporting ferrule portions to be formed with the discontinuous radius and corner 31. The terminating end 34 of the ferrule portions 32 is then chamfered to allow for ease of insertion of the tubes into the endsheet. After the chamfering processing, the strengthening ribs 38 are formed at the interface of the flanges 26 and the base portion 24 by an angled punching operation. The endsheet is then cleaned and degreased and ready for installation in the heat exchanger 10. As stated above, by providing an extruded hole having a discontinuous radius forming corner, the tube 12 can be inserted through the endsheet but is held in place in the endsheet during the expansion process of the tube whereby a mandrel of diameter slightly greater than that of the tube is inserted through the tube to provide for better or increased fin contact area. By providing the corner of the discontinuous radius, the present invention overcomes the problems associated with prior art extruded ferrules during the manufacturing process of the heat exchanger.

In view of the above, variations and modifications to the present invention will no doubt occur to those skilled in the art. For example, the endsheet can be manufactured from a variety of known materials known to one of ordinary skill in the art. It is the following claims, including all equivalents which define the scope of the invention.

What is claimed is:

1. A heat exchanger for an automotive vehicle, comprising:

a manifold assembly;

a plurality of tubular elements being connected to the manifold assembly and defining air paths between adjacent pairs of tubular elements;

a plurality of fin elements provided in said air paths; and at least one support member disposed adjacent said manifold assembly, said support member having a generally planar base portion including a plurality of tube receiving apertures therein, each of said apertures including a curvilinear portion terminating in a discontinuous radius and forming a cylindrically extending ferrule portion of predetermined length thereby, said ferrule portion extending generally perpendicularly to the plane of said base portion and being configured to support a tubular element.

2. A heat exchanger according to claim 1, wherein said predetermined length of said ferrule portions is proportional to the diameter of said tubular elements.

3. A heat exchanger according to claim 2, wherein said length of said ferrule portions is at least 25% greater than the diameter of said tubular elements.

4. A heat exchanger according to claim 1, wherein said ferrule portion includes a terminating end opposite said base portion of said support member, said terminating end being chamfered.

5. A heat exchanger according to claim 1, wherein said support member further includes a plurality of strengthening ribs formed therein.

6. A heat exchanger according to claim 1, further including an additional support member disposed at an opposite end of said heat exchanger from said at least one support member.

7. A heat exchanger according to claim 1, wherein said apertures are formed by extrusion.

8. A condenser for liquefying gaseous coolant in an air conditioning system of an automobile after the system has compressed the coolant, said condenser comprising:

a manifold assembly defining a coolant inlet and a coolant outlet for said condenser;

a plurality of tubular elements being connected to the manifold assembly and defining air paths between adjacent pairs of tubular elements;

a plurality of fin elements provided in said air paths; and a pair of support members disposed at opposite ends of said condenser for supporting the tubular elements thereby, said support members having a generally U-shaped cross-section including a planar base portion and a pair of flanges extending generally perpendicularly to the plane of said base portion, said base portion including a plurality of tube receiving apertures therein, each of said apertures including a curvilinear portion terminating in a discontinuous radius and forming a cylindrically extending tube-supporting ferrule portion of predetermined length thereby, said ferrule portion extending generally perpendicularly to the plane of said base portion and terminating in an end opposite said base portion of said support member, said terminating end being chamfered.

9. A heat exchanger according to claim 8, wherein said predetermined length of said tube-supporting ferrule portions is proportional to the diameter of said aperture.

10. A heat exchanger according to claim 9, wherein said length of said tube-supporting ferrule portions is at least 25% greater than the diameter of said apertures.

11. A heat exchanger according to claim 8, wherein said support member further includes a plurality of strengthening ribs interposed between said base portion and said flanges of said support member.

* * * * *